US007331288B2

(12) United States Patent
Göttling et al.

(10) Patent No.: US 7,331,288 B2
(45) Date of Patent: Feb. 19, 2008

(54) APPARATUS FOR PULLING A SLEEVE ON AND OFF

(75) Inventors: Josef Göttling, Friedberg (DE); Thomas Hartmann, Mering (DE); Godber Petersen, Augsberg (DE)

(73) Assignee: Man Roland Druckmaschinen AG, Augsburg (DE)

( * ) Notice: Subject to any disclaimer, the term of this patent is extended or adjusted under 35 U.S.C. 154(b) by 245 days.

(21) Appl. No.: 11/117,416

(22) Filed: Apr. 29, 2005

(65) Prior Publication Data

US 2005/0274268 A1 Dec. 15, 2005

(51) Int. Cl.
*B41L 38/00* (2006.01)

(52) U.S. Cl. ..... 101/480; 101/216; 101/375; 101/485

(58) Field of Classification Search ..... 101/216, 101/477, 375, 480, 485
See application file for complete search history.

(56) References Cited

U.S. PATENT DOCUMENTS

| | | | | |
|---|---|---|---|---|
| 4,089,265 | A | 5/1978 | White et al. | |
| 4,384,522 | A * | 5/1983 | Ehlers et al. | 101/177 |
| 4,823,693 | A * | 4/1989 | Kobler | 101/218 |
| 6,142,073 | A * | 11/2000 | Zeman et al. | 101/216 |
| 6,386,103 | B1 * | 5/2002 | Charette et al. | 101/375 |
| 6,463,648 | B2 * | 10/2002 | Gottling et al. | 29/426.1 |
| 7,117,793 | B2 * | 10/2006 | Petersen et al. | 101/477 |
| 2003/0213389 | A1 * | 11/2003 | Kolbe et al. | 101/382.1 |
| 2004/0079250 | A1 * | 4/2004 | Lorig et al. | 101/375 |

FOREIGN PATENT DOCUMENTS

| | | |
|---|---|---|
| DE | 470 937 C | 9/1927 |
| DE | 195 00 729 A1 | 7/1996 |
| DE | 100 23 152 A1 | 11/2001 |
| DE | 101 02 269 A1 | 8/2002 |
| DE | 102 23 414 A1 | 8/2004 |
| EP | 0 962 316 A1 | 6/1998 |
| GB | 461782 | 2/1937 |

* cited by examiner

*Primary Examiner*—Jill E. Culler
(74) *Attorney, Agent, or Firm*—24IP Law Group; Timothy R. DeWitt

(57) ABSTRACT

In order to make handling easier, an apparatus for pulling a sleeve onto and off a printing-press cylinder has a head piece (8) having a positioning device (13) for defining the position of the head piece (8) with respect to the cylinder (1), a connecting device (14, 15) for fixing the head piece (8) to the cylinder (1), and a centering device (12) for defining the position of the sleeve (2) with respect to the head piece (8) and a deposition bar (9) for the sleeve (2), which deposition bar (9) is attached to the head piece (8).

13 Claims, 4 Drawing Sheets

APPARATUS FOR PULLING A SLEEVE ON AND OFF

CROSS-REFERENCE TO RELATED APPLICATIONS

This application claims priority under 35 U.S.C. § 119 to German patent application number 10 2004 021 494.8, filed 30 Apr. 2004, the entirety of which is incorporated by reference herein.

STATEMENT REGARDING FEDERALLY SPONSORED RESEARCH OR DEVELOPMENT

Not applicable.

BACKGROUND OF THE INVENTION

Field of the Invention

The invention relates to an apparatus for pulling a sleeve onto and off a printing-press cylinder.

SUMMARY OF THE INVENTION

The present invention provides an apparatus for pulling a sleeve on and off a printing press cylinder more easily than in conventional systems. The present invention achieves this by a head piece having positioning means for defining the position of the head piece with respect to the cylinder, connecting means for fixing the head piece to the cylinder, and centering means for setting the position of the sleeve with respect to the head piece and a deposition bar for the sleeve, which deposition bar is attached to the head piece. An apparatus of this type affords the advantage that it is automatically positioned precisely on the cylinder after connection. A sleeve can thus be pulled on or off without the risk of damage to the sleeve.

According to one embodiment of the invention, the head piece has a vertical strut and a transverse strut, with, in order to form the positioning means on the transverse strut, pressure pins being provided which can be brought into engagement with depressions in an end of the cylinder, and in order to form the connecting means, a fixed angled-away stop being arranged at one end of the vertical strut and a pivotable bolt being arranged at the other end of the vertical strut, in each case in order to engage behind a flange of the cylinder, and in order to form the centering means, in each case one roll-shaped centering strip which extends in the axial direction of the cylinder being arranged at both ends of the transverse strut. A construction of this type can be realized with a low weight.

To make handling even easier, another embodiment further comprises a gripper, which can be moved in the axial direction of the cylinder with respect to the deposition bar, for the sleeve. The gripper can be moved between a position for gripping a sleeve, which is situated on the cylinder, and an outer position which releases the sleeve.

According to another embodiment of the present invention, an apparatus useful for pulling a sleeve onto and off of a printing-press cylinder includes a head piece having positioning means for defining the position of the head piece with respect to the cylinder, a deposition bar for the sleeve, the deposition bar being attached to the head piece, connecting means for fixing the head piece to the cylinder, and centering means for defining the position of the sleeve with respect to the head piece and the deposition bar.

According to another embodiment of the present invention, the head piece has a vertical strut and a transverse strut, the positioning means comprises pressure pins on the transverse strut, the pressure pins configured and arranged to be brought into engagement with depressions in an end of the cylinder, the connecting means comprises a fixed angled-away stop arranged at one end of the vertical strut and a pivotable bolt arranged at the other end of the vertical strut, the fixed angled-away stop and the pivotable bolt configured and arranged to engage behind a flange of the cylinder, and the centering means comprises one roll-shaped centering strip extending in an axial direction of the cylinder at both ends of the transverse strut. Each pressure pin may have a hollow basic body having a flanged-over edge, a spring arranged in the body, and a ball, the spring pressing the ball against the flanged-over edge of the basic body.

According to another embodiment of the present invention, the apparatus further comprises a gripper for the sleeve movable in an axial direction of the cylinder with respect to the deposition bar, the gripper being movable between a position for gripping a sleeve which is situated on the cylinder and an outer position which releases the sleeve. The gripper may comprise a gripper housing and a plurality of gripper arms mounted on the gripper housing and movable perpendicularly with respect to the cylinder axis.

According to another embodiment of the present invention, the apparatus further comprises a threaded spindle configured and arranged to displace the gripper housing. The threaded spindle may be positioned on the deposition bar.

According to another embodiment of the present invention, the apparatus further comprises a handwheel configured and arranged to rotate the threaded spindle.

According to another embodiment of the present invention, the apparatus further comprises a gear mechanism and a plurality of racks each of which carry one of the gripper arms. The racks mounted in the gripper housing and the racks and gear mechanism are mutually configured and arranged for the gear mechanism to displace the racks to open and close the gripper.

According to another embodiment of the present invention, the apparatus further comprises a spur gear and a handwheel configured and arranged to rotate the spur gear, wherein the gear mechanism includes one pinion which engages into each rack, the pinions being drive-connected to the spur gear.

According to another embodiment of the present invention, the apparatus further comprises a spindle and a handwheel configured and arranged to rotate the spindle, wherein one of the pinions is seated on the spindle.

According to another embodiment of the present invention, each gripper arm comprises a suction head.

According to another embodiment of the present invention, a printing-unit cylinder useful for attaching an apparatus is provided, wherein the positioning means comprises pressure pins each including a ball, the cylinder comprising a flange configured and arranged to fix the connecting means, and depressions configured and arranged to engage the pressure pin balls.

According to another embodiment of the present invention, the depressions are conical.

Still other aspects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to exemplary embodiments of the apparatus and method, given only by way of example, and with reference to the accompanying drawings, in which.

DETAILED DESCRIPTION OF EXEMPLARY EMBODIMENTS

Figure 1:
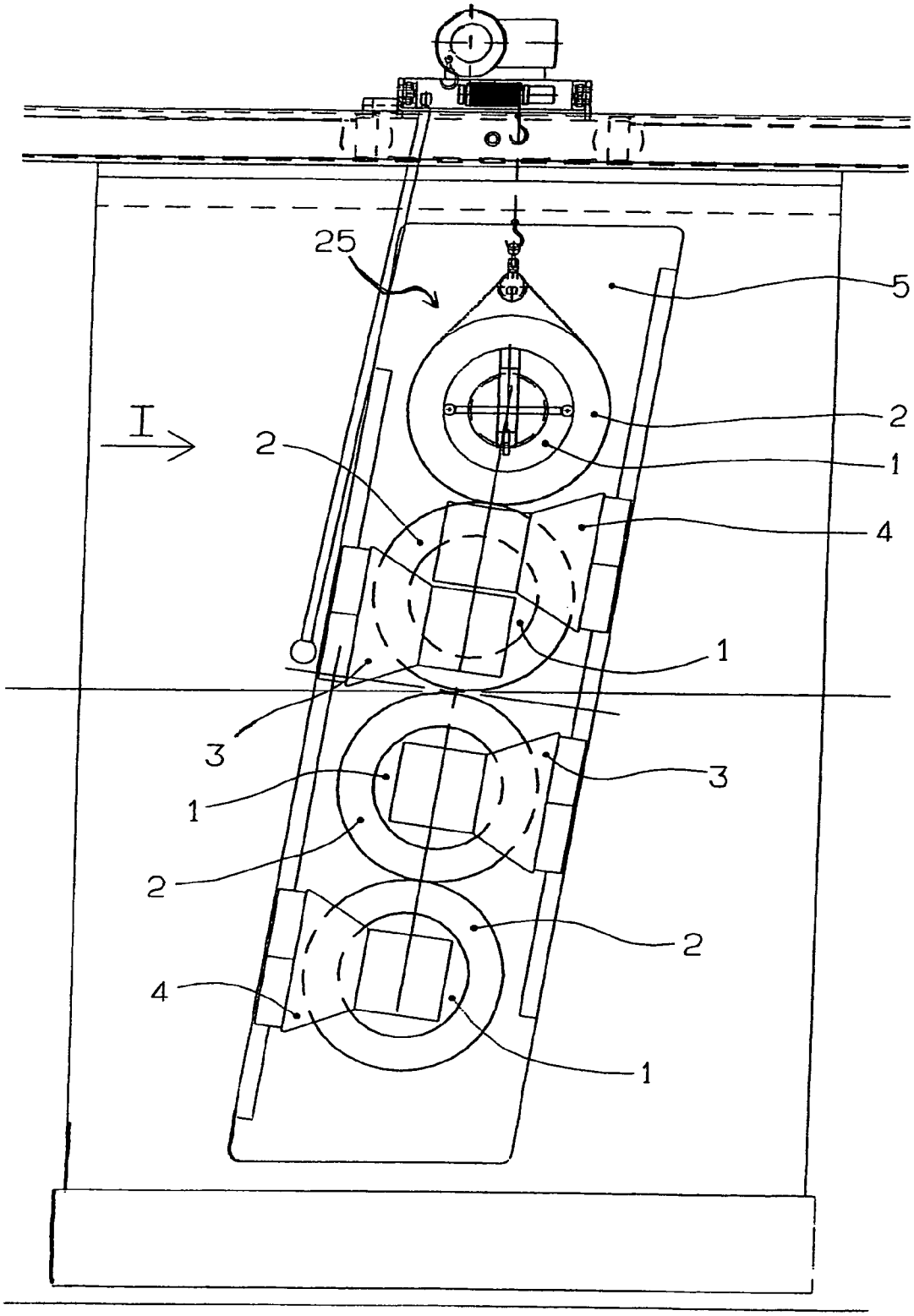
FIG. 1 shows a side view of a printing unit.

Referring to the drawing figures, like reference numerals designate identical or corresponding elements throughout the several figures.

FIG. 1 shows a printing unit for recto and verso printing, having a plurality of cylinders 1, of a web-fed rotary offset press. A sleeve 2 which bears either the printing medium or a rubber blanket is pulled onto each cylinder 1. The cylinders 1 are mounted fixedly on a side wall of the printing press in a manner which is known per se and not shown. They are held on bearing blocks 3, 4 on the other side. The bearing blocks 3, 4 are held displaceably on the edge of a side-wall opening 5. In FIG. 1, the bearing block 4 is displaced to such an extent that the uppermost cylinder 1 having the sleeve 2 is freely accessible through the side-wall opening 5.

Figure 2:
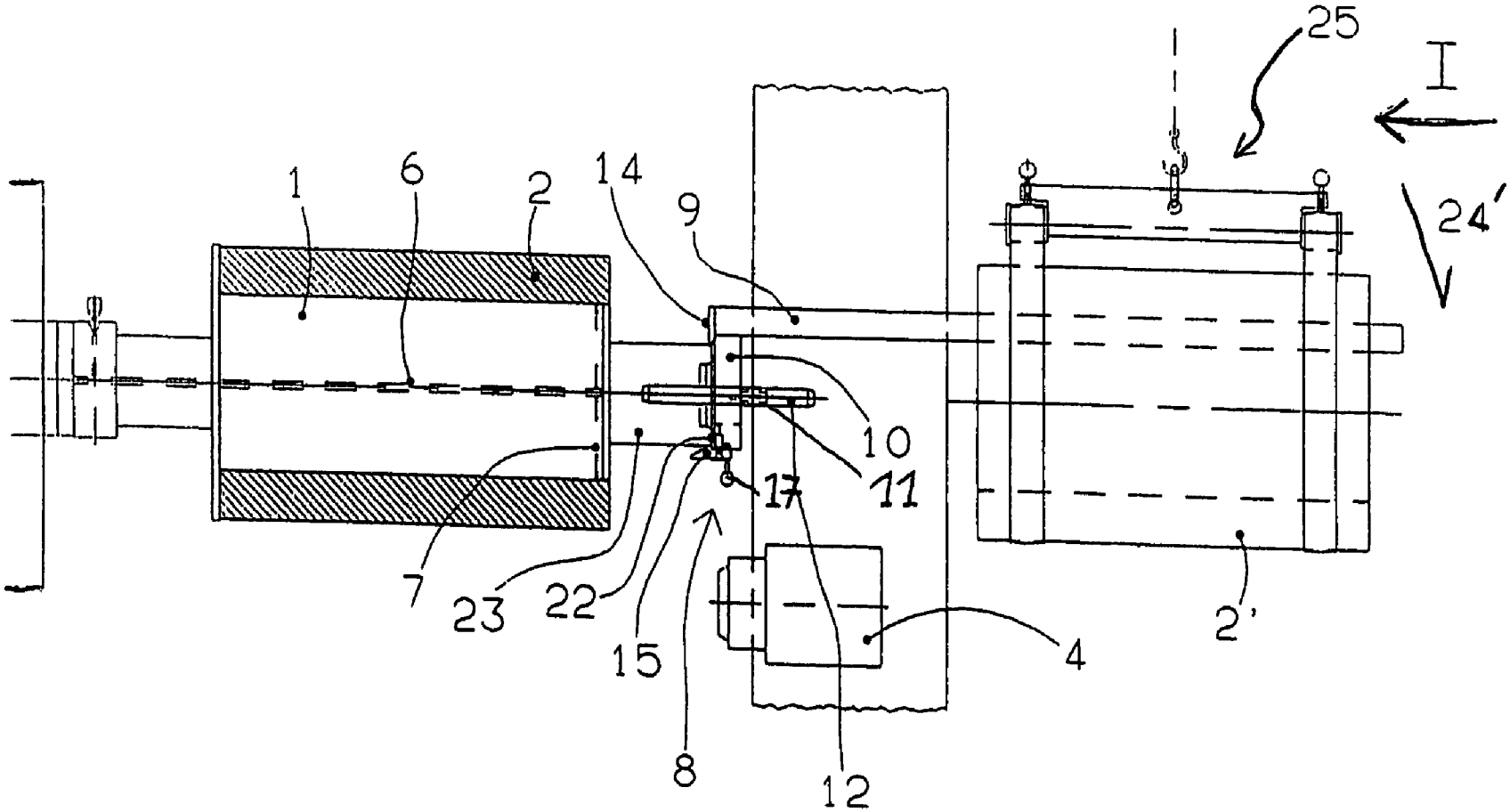
FIG. 2 shows a side view of a first embodiment.

FIG. 2 diagrammatically shows a cylinder 1 having a sleeve 2 which is shown cut open and is to be removed. In order to prepare for this, compressed air is introduced between the cylinders 1 and the sleeve 2 in a manner known per se via air ducts 6 and 7 which are connected to a compressed air generator.

Figure 6:
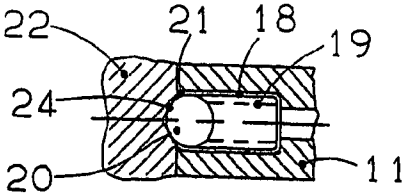
FIG. 6 shows a section through a pressure pin.
Figure 4:
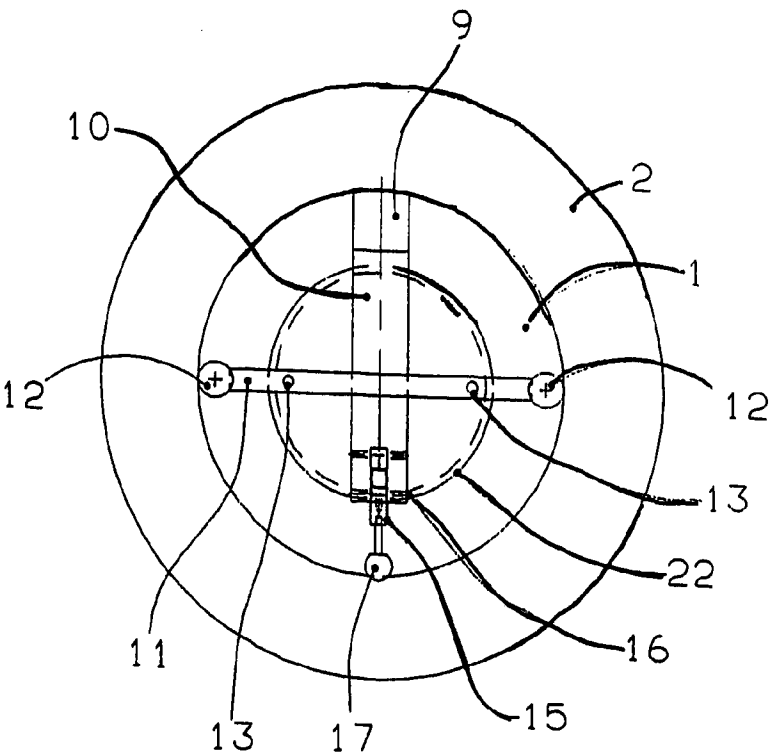
FIG. 4 shows a view in the direction of the arrow I in FIG. 2, with the lifting apparatus removed.

The apparatus for pulling the sleeve 2 on and off has a head piece which is denoted overall by 8. A deposition bar 9 is attached fixedly to the head piece. As FIG. 4 shows, the head piece 8 has a vertical strut 10 and a transverse strut 11. In each case one roll-shaped centering strip 12 which extends parallel to the deposition bar 9 is attached fixedly at both ends of the transverse strut 11 as centering means. The mutual spacing of the centering strips corresponds to the internal diameter of the sleeve 2. The centering strips 12 thus center the sleeve 2 which is suspended on the deposition bar, with respect to the head piece 8. Furthermore, the transverse strut 11 bears pressure pins 13 as positioning means. As FIG. 6 shows, the pressure pins 13 comprise a cup-shaped basic body 18 in which a spring 19 is arranged which holds a ball 20 in contact with a flanged-over edge 21 of the basic body 18. The vertical strut 10 is provided with a fixed angled-away stop 14 at one end. At the other end, it bears a bolt 15 which can be pivoted about an axis 16. A spring which attempts to hold the bolt in the locking position is arranged between the bolt 15 and the strut 10. The bolt can be transferred into the open position by means of a handle 17. The parts 14 and 15 form connecting means for fixing the head piece 8 on the cylinder 1.

The cylinder 1 has a flange 22 of relatively large diameter on its axle journal 23. Furthermore, depressions 24 which each serve to accommodate a part of the ball 20 of a pressure pin 13 are made in the end of the flange 22. The depressions 24 are expediently of conical configuration, in order to position the head piece 8 precisely with respect to the axle journal 23 of the cylinder 1. A pyramidal, round or cylindrical design is also conceivable.

In order to pull off the sleeve 2, the head piece 8 with the deposition bar 9 is attached slightly obliquely in such a way that the angled-away stop 14 reaches over the flange 22 of the axle journal 23 of the cylinder 1. Subsequently, the balls 20 of the two pressure pins 13 are brought into engagement with the depressions 24 in the axle journal 23, partially under stressing of the spring 19, by means of a slight pivoting movement in the direction of the arrow 24'. At the same time, the bolt 15 latches behind the flange 22 under spring action, in order to fix the head piece 8 to the cylinder 1.

In a further step, the sleeve 2 is pushed onto the deposition bar 9 until it lies in position 2' under a lifting apparatus 25, on which it is suspended and removed. After the bolt 15 is released by means of the handle 17, the head piece 8 with the deposition bar 9 can be pulled out through the sleeve lying in position 2', until the sleeve 2' is free to be transported away by means of the lifting apparatus 25. Here, the spring 19 assists the release of the head piece 8 from the flange 22.

The movement processes run in the reverse order when a sleeve 2 is being pulled onto the cylinder 1. Initially, the sleeve 2 is moved into the position 2' shown in FIG. 2 by means of the lifting apparatus 25. Subsequently, the head piece 8 is attached with the angled-away stop 14 behind the flange 22, and is moved by pivoting in the direction of the arrow 24' to such an extent that the balls 20 of the pressure pins 13 engage partially into the depressions 24 and the bolt 15 latches behind the flange 22. Then, after the lifting apparatus 25 has been removed, the sleeve 2 is displaced along the deposition bar 9 in the direction towards the cylinder 1. Here, the centering strips 12 ensure that the sleeve 2 assumes the correct position with regard to the head piece 8 and thus with regard to the cylinder 1.

Figure 3:
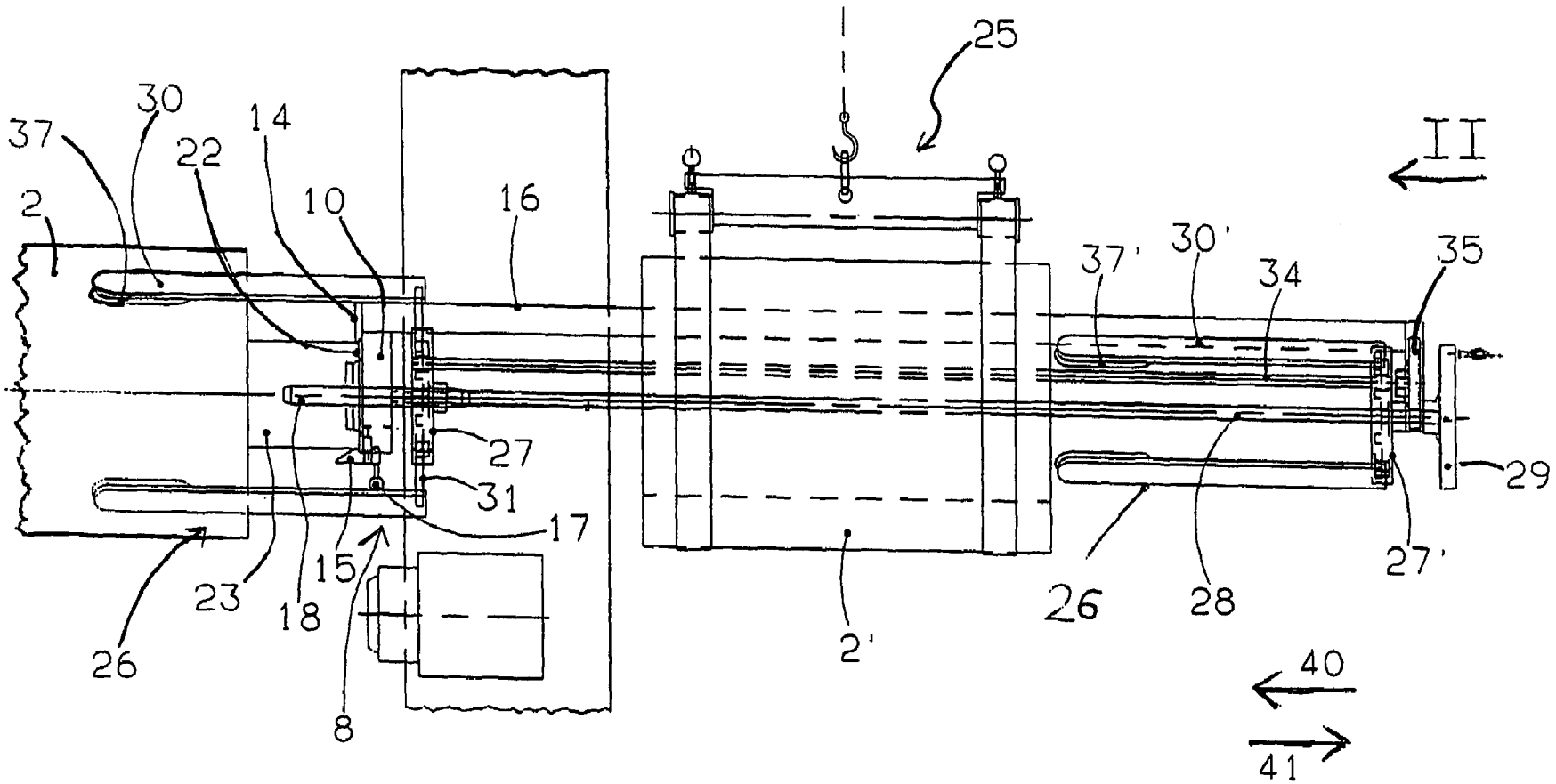
FIG. 3 shows a view of a second embodiment.
Figure 5:
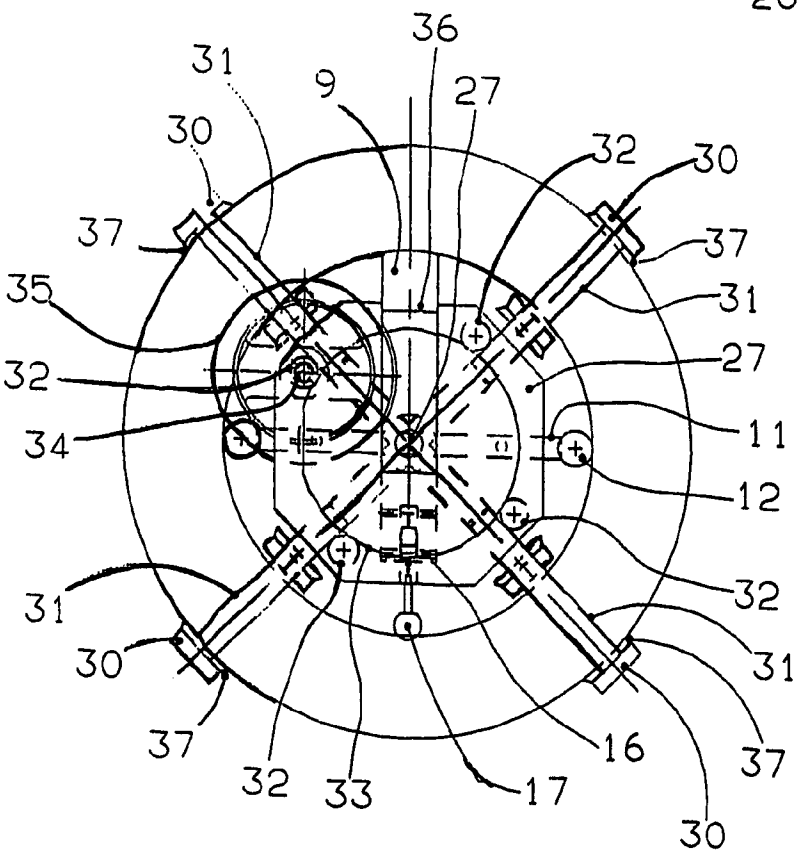
FIG. 5 shows a view in the direction of the arrow II in FIG. 3, likewise with the lifting apparatus removed.

The exemplary embodiment according to FIGS. 3 and 5 has a head piece 8 and a deposition bar 9 which are configured in the same way as in the first exemplary embodiment and are therefore not described again. In addition, a gripper is provided which is denoted overall by 26 and has a gripper housing 27. The gripper housing 27 is in engagement with a threaded spindle 28 which is held on the deposition bar 9 in a manner not shown and such that it can be rotated by means of a handwheel 29. The gripper housing 27 with the gripper 26 can be moved in or counter to the direction of the arrow 40 by actuation of the handwheel 29.

The gripper 26 has four gripper arms 30 which are each connected fixedly to a rack 31. Every rack 31 is in engagement with a pinion 32. All of the pinions 32 engage into a spur gear 33. In order to rotate the spur gear 33, one of the pinions 32 is placed on a spindle 34 which can be actuated by means of a handwheel 35. Here, the gripper housing 27 has a groove 36, with which it is guided on the deposition bar 9 such that it cannot rotate. The gripper arms 30 each bear a suction head 37. Every suction head is connected to supply lines (not shown) in order to generate the vacuum.

As an alternative, instead of the four gripper arms 30, it is also possible to use one gripper which has a ring of U-shaped cross section and which is connected to the end of the sleeve by suction. Another alternative can consist in that a ring element is arranged on the sleeve, which ring element has radial round or elongate cut-outs into which the appropriately configured gripper arms engage in order to produce a form-fitting connection.

In the position of the parts which is shown on the left in FIG. 3 and in FIG. 5, the suction heads 37 of the gripper arms 30 have gripped a sleeve 2 which is seated on a cylinder. The gripper housing 27 with the gripper arms 30 is moved in the direction of the arrow 41 by actuation of the handwheel 29, until the sleeve 2 has arrived under the lifting means 25. The compressed air is then turned off and the gripper arms 30 are raised slightly from the sleeve 2 by rotation of the handwheel 35. Subsequently, the gripper housing is transferred into the position 27' by further rotation of the handwheel 29 and, after the head piece 8 has been released from the axle journal 23, the entire apparatus is pulled out of the sleeve 2' which is suspended on the lifting apparatus 25.

If a new sleeve 2 is to be pulled onto the cylinder, the entire apparatus is initially pushed through the sleeve 2' which is suspended on the lifting apparatus 25, and then, in the same way as described in the first exemplary embodiment, is fastened with the head piece 8 to the axle journal 23 of the cylinder 1. Subsequently, the gripper arms 30 are transferred by rotation of the handwheel 35 into a position in which they grip the sleeve in position 2'. After the suction heads 37 have been activated, the gripper arms 30 which are fixed to the sleeve 2 are moved further in the direction of the arrow 40 by rotation of the handwheel 29, until the sleeve 2 has been pushed onto the cylinder 1. After the gripper arms 30 and the bolt 15 have been released, the entire apparatus can be removed again, with the result that, after the bearing block 4 has been displaced, the printing unit is ready for operation again.

The additional advantage of the apparatus according to FIGS. 3 and 5 is to be seen in the fact that the sleeve no longer has to be pulled by hand from the cylinder 1 onto the deposition bar 9 and pushed from the deposition bar 9 onto the cylinder 1.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. An apparatus useful for pulling a sleeve onto and off of a printing-press cylinder, the apparatus comprising:

a head piece having positioning means for defining the position of the head piece with respect to the cylinder;

a deposition bar for the sleeve, the deposition bar being attached to the head piece;

connecting means for fixing the head piece to the cylinder; and centering means for defining the position of the sleeve with respect to the head piece and the deposition bar;

wherein the head piece has a vertical strut and a transverse strut;

wherein the positioning means comprises pressure pins on the transverse strut, the pressure pins configured and arranged to be brought into engagement with depressions in an end of the cylinder;

wherein the connecting means comprises a fixed angled-away stop arranged at one end of the vertical strut and a pivotable bolt arranged at the other end of the vertical strut, the fixed angled-away stop and the pivotable bolt configured and arranged to engage behind a flange of the cylinder; and wherein the centering means comprises one roll-shaped centering strip extending in an axial direction of the cylinder at both ends of the transverse strut.

2. An apparatus according to claim 1, wherein every pressure pin has a hollow basic body having a flanged-over edge, a spring arranged in the body, and a ball, the spring pressing the ball against the flanged-over edge of the basic body.

3. An apparatus according to claim 1, further comprising:

a gripper for the sleeve movable in an axial direction of the cylinder with respect to the deposition bar, the gripper being movable between a position for gripping a sleeve which is situated on the cylinder and an outer position which releases the sleeve.

4. An apparatus according to claim 3, wherein the gripper comprises a gripper housing and a plurality of gripper arms mounted on the gripper housing and movable perpendicularly with respect to the cylinder axis.

5. An apparatus according to claim 4, further comprising:

a threaded spindle configured and arranged to displace the gripper housing.

6. An apparatus according to claim 5, wherein the threaded spindle is positioned on the deposition bar.

7. An apparatus according to claim 5, further comprising:

a handwheel configured and arranged to rotate the threaded spindle.

8. An apparatus according to claim 4, further comprising:

a gear mechanism; and a plurality of racks which each carry one of said gripper arms, the racks mounted in the gripper housing;

wherein the racks and gear mechanism are mutually configured and arranged for the gear mechanism to displace the racks to open and close the gripper.

9. An apparatus according to claim 8, further comprising:

a spur gear; and a handwheel configured and arranged to rotate the spur gear;

wherein the gear mechanism includes one pinion which engages into each rack, the pinions being drive-connected to the spur gear.

10. An apparatus according to claim 9, further comprising:

a spindle; and a handwheel configured and arranged to rotate the spindle;

wherein one of the pinions is seated on the spindle.

11. An apparatus according to claim 4, wherein every gripper arm comprises a suction head.

12. An apparatus according to claim 1, wherein the positioning means comprises pressure pins each including a ball, the cylinder comprising:

a flange configured and arranged to fix the connecting means; and depressions configured and arranged to engage the pressure pin balls.

13. An apparatus according to claim 12, wherein the depressions are conical.

* * * * *